United States Patent [19]

Calabretta

[11] 4,012,183

[45] Mar. 15, 1977

[54] ROTARY VANE COMPRESSOR WITH VANE EXTENSION MEANS

[75] Inventor: Peter Trent Calabretta, York, Pa.

[73] Assignee: Borg-Warner Corporation, Chicago, Ill.

[22] Filed: Dec. 9, 1975

[21] Appl. No.: 639,030

[52] U.S. Cl. ..... 418/238; 418/266; 267/152

[51] Int. Cl.[2] ..... F01C 1/00; F04C 17/00; F16F 3/10

[58] Field of Search ..... 418/122, 238, 248, 266, 418/267, 123; 267/152

[56] References Cited

UNITED STATES PATENTS

| | | | |
|---|---|---|---|
| 2,045,014 | 6/1936 | Kenney et al. | 418/238 |
| 2,552,840 | 5/1951 | Burke et al. | 418/266 |
| 2,899,940 | 8/1959 | Gibbs et al. | 418/266 |
| 3,191,503 | 6/1965 | Fuehrer | 418/266 |
| 3,376,825 | 4/1968 | Burnett | 418/266 |

*Primary Examiner*—John J. Vrablik
*Attorney, Agent, or Firm*—Thomas B. Hunter

[57] ABSTRACT

A rotary sliding vane compressor having means for biasing the vanes outwardly. Such means include a resilient element located in the lower portion of the vane slot and engaging a convexly shaped edge on the vane. The flexing action of the resilient member insures that the vanes will be moved outwardly during the expansion phase of rotor travel.

3 Claims, 6 Drawing Figures

FIG.1
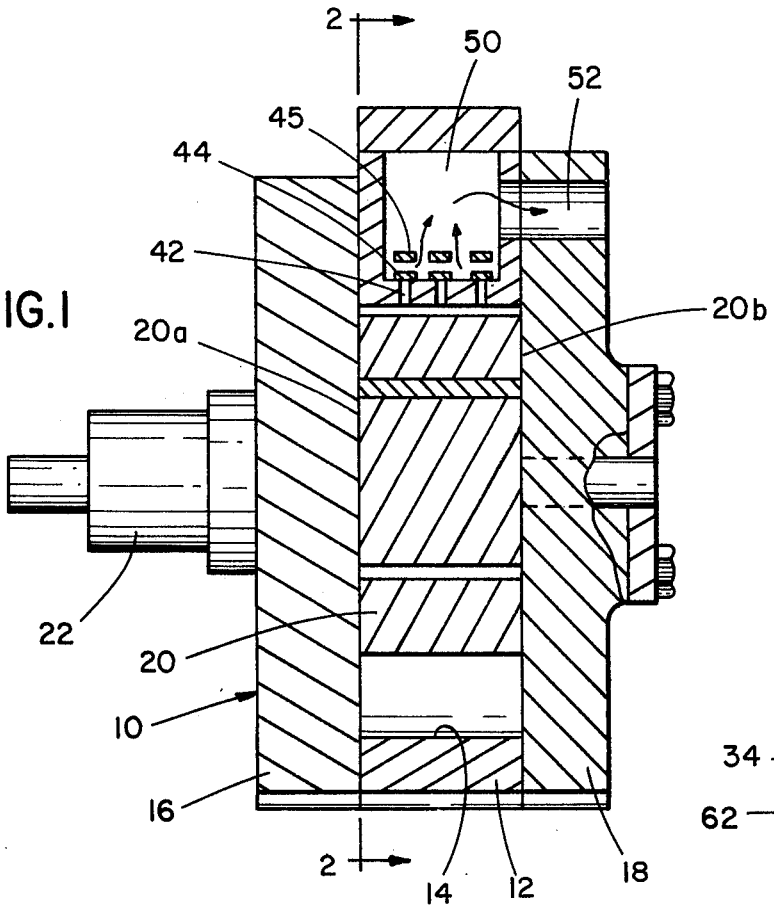
FIG.3
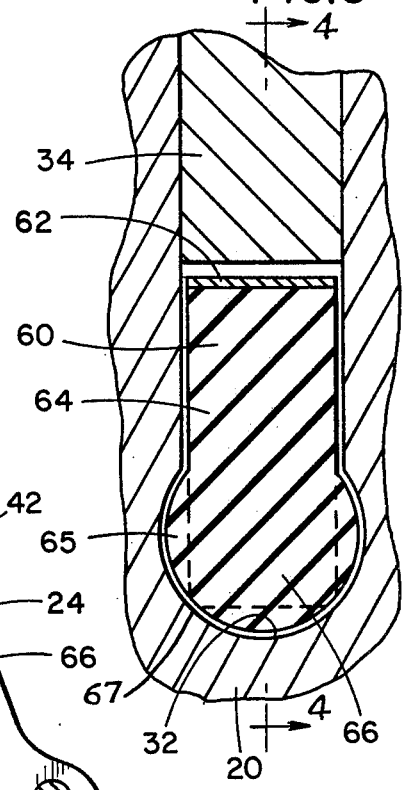
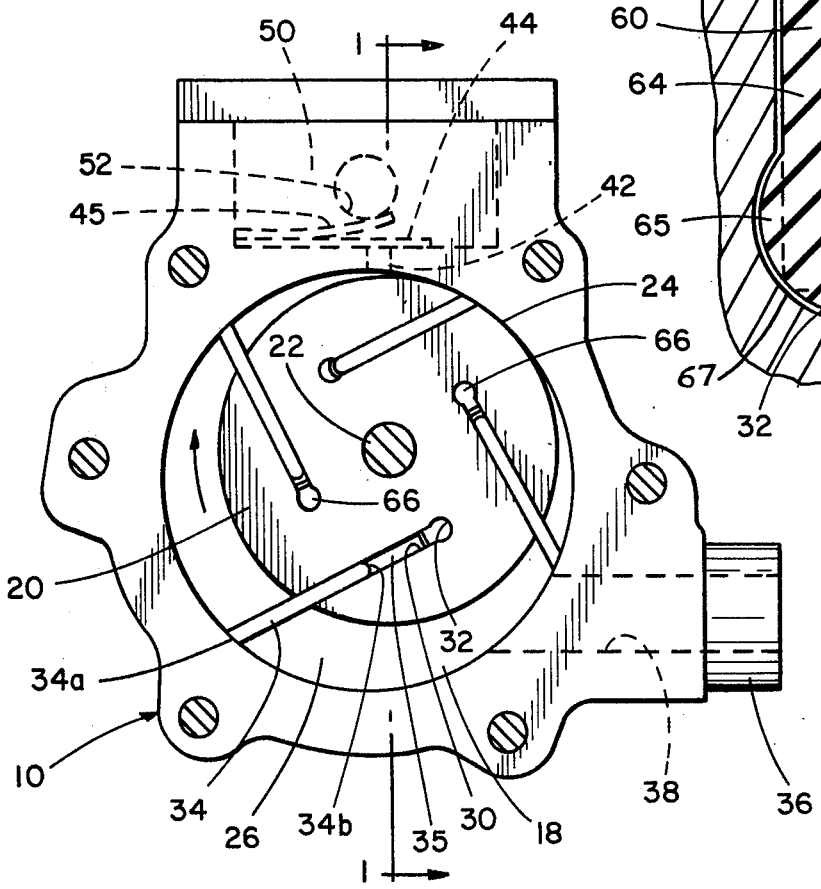
FIG.2

ROTARY VANE COMPRESSOR WITH VANE EXTENSION MEANS

BACKGROUND OF THE INVENTION

1. Field of the Invention

A rotary sliding vane compressor having means for urging the vanes outwardly and maintaining the vane tips in engagement with the cylindrical rotor surface.

2. Description of the Prior Art

Burnett U.S. Pat. No. 3,376,825 describes a rotary vane compressor having a leaf type spring element between the radially inner portion of the vane and the bottom of the vane slot. The spring is designed so that during high speed operation, when centrifugal forces are sufficient to maintain the vane tips in contact with the cylinder wall, the same centrifugal forces will cause the spring to collapse against radially inner edges of the vane and thus become ineffective as a spring element.

English U.S. Pat. No. 1,984,365 describes a rotary sliding vane compressor having a leaf type spring in the bottom of the vane slot and having its convex side in contact with the central region of the vane edge which is essentially linear.

Kenney et al U.S. Pat. No. 2,045,014 also discloses a leaf spring with its ends embedded in the bottom of the vane.

Fuehrer U.S. Pat. No. 3,191,503 shows a sliding vane fluid handling apparatus which uses O-rings of elastomeric material underneath the vanes to bias the same outwardly.

Gibson et al U.S. Pat. No. 1,857,276 is representative of a large number of prior art references which utilize fluid pressure underneath the vanes to maintain the vane tips in engagement with the cylinder wall.

SUMMARY OF THE INVENTION

This invention relates in general to rotary sliding vane compressors and more particularly to an effective means for biasing the vanes radially outwardly to maintain the vane tips in sliding engagement with the cylindrical wall of the rotor chamber which forms the gas working space. Although rotor sliding vane compressors are known in a great many forms, the description herein is directed to a conventional type in which a rotor is provided with a plurality of extensible vanes each received within a generally radially oriented or canted vane slot in the rotor. The rotor is received within a cylindrical chamber or stator and mounted such that its axis is offset with respect to the cylindrical stator axis, thus providing a generally crescent shaped gas working space. The rotor is in sliding contact with a portion of the cylindrical wall, and this contact point divides the low pressure side from the high pressure side. An inlet port communicates with one side of the gas working space and a discharge port communicates with the opposite side. Gas is trapped between adjacent vanes and carried around through the compression zone. The volume of each pocket or compartment, as defined between adjacent vanes and the rotor and stator surfaces, becomes smaller as it approaches the discharge port thus compressing the gas trapped therein.

A problem is often encountered in operating compressors of the type described above in that the vanes sometimes will not maintain their tips in engagement with the cylindrical stator wall under all conditions. This is especially true at start-up when the rotor is traveling at low rotational velocities. The centrifugal force which would normally tend to throw the vanes outwardly is not sufficient to overcome the vacuum created when the vanes begin to move from their most radially inward portion to the point directly opposite the contact point. The latter may be regarded as a dash-pot effect and is extremely powerful in resisting the outward thrust of the vanes.

Several techniques have been used in the prior art to hold the vane tips in engagement with the cylindrical wall. Basically, these may be divided into two categories: mechanical (such as springs) and hydraulic or pneumatic. The mechanical springs used may take many forms, such as the leaf springs described in Burnett, Kenney et al and English, or helical (coil) springs. Just as common are the hydraulic on pneumatic means such as described in Gibson et al.

In the present invention, a different type of mechanical element is employed which overcomes many of the disadvantages of the springs heretofore known. It is difficult to obtain any significant service life when using a leaf or coil spring in the typical rotary compressor environment. With each revolution of the rotor the spring is compressed and released. Since the compressors operate at several hundred R.P.M., it is apparent that the springs undergo unusually high stresses.

The objective of the present invention is to minimize the amount of flexure involved, especially the total travel distance for each compression and extension of the spring. Moreover, a typical metal spring has been found to be of limited utility; and the present invention employs a novel composite spring having a metal portion to provide the necessary rigidity and wear surface, and a bonded rubber or elastomeric component to extend the life of the metal element.

Still another aspect of the invention is the superior load distribution which is accomplished by mating the curved vane bottom with a bridge-like rubber/metal composite spring assembly. Moreover, the wear surface provided by the metal spring, in combination with the rubber or elastomeric element, is effective in dampening noise during operation. The assembly is compact, inexpensive to install, and requires no special modifications to conventional compressor parts.

Other advantages to this system include the fact that since no hydraulic means are provided for maintaining the vanes extended, it is not necessary to provide either a lubricant pump or other means for collecting and distributing oil and/or refrigerant to the undervane spaces. It also provides instant pumping action upon start-up, is quieter, eliminates reverse rotation at rotor shutdown, often caused by equalization of pressures between the high and low sides of the compressor rotor, and results in lower discharge gas temperatures.

BRIEF DESCRIPTION OF THE DRAWINGS

FIG. 1 is a cross sectional view of a rotary sliding vane compressor constructed in accordance with the principles of the present invention;

FIG. 2 is a cross sectional view taken along the plane of line 2—2 of FIG. 1;

FIG. 3 is a greatly enlarged sectional view showing the relationship of the resilient element with respect to the vane and the vane slot;

DESCRIPTION OF THE PREFERRED EMBODIMENT

Figure 4:
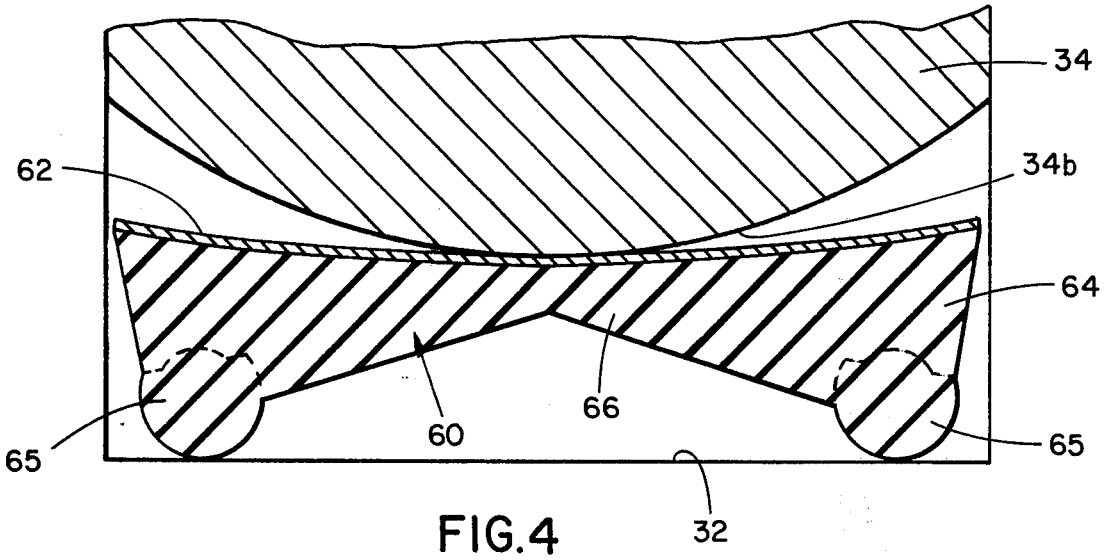
FIG. 4 is a cross sectional view taken along the plane of line 4—4 of FIG. 3.

Referring now to the drawings, particularly to FIGS. 1 and 2, there is shown a rotary compressor of generally conventional design including a stator housing 10 comprising a cylinder block 12 having a circular bore extending therethrough to provide a cylinder wall 14, a front end plate 16, and a rear end plate 18. Within housing 10 there is provided a rotor 20 connected to and driven by drive shaft 22. The rotor is eccentrically mounted within the cylinder 14 so that it is in close running contact with the cylinder wall 14 at a contact point 24 and forms a cresent-shaped gas working space or compression cavity 26. The rotor is provided with a plurality of vane slots 30 each having a bottom surface 32 and receiving vanes 34 which are adapted to reciprocate within each vane slot with their upper edges **34*a* in continuous engagement with cylinder wall 14. It may be seen that the lower sides of each slot, the bottom edge 34*b* of the vanes 34, and the bottom of the vane slot 32 define what will be referred to as the "under-vane space," designated 35**.

Suction gas is admitted to the compression cavity 26 through connection 36 and passage 38. Gas is discharged through a series of openings 42 (adjacent the contact point) which are covered by read-type discharge valves 44, limited by valve stops 45. Discharge gas flows into chamber 50 and then into passage 52 in rear plate 18 and out through connection 54.

Located between the lower edge of each vane and the bottom of the vane slot 32 is a resilient element 60 which includes a first component in the form of a flat spring 62 formed of spring steel or other suitable alloy having good wear characteristics and adapted to withstand a large number of flexures at high frequency without failure. Bonded to the spring element is an elastomeric damper 64 having enlarged, spherically shaped terminal portions 65 and a central section 66 having a relatively thin cross sectional area as compared to the end portions. The spherically shaped ends 65 of damper 66 are adapted to seat in complementary sockets 67 formed in the ends of vane slot 32. This arrangement provides pivot points at each end so that the ends of resilient element 60 do not abrade against the bottom of the slot.

As best shown in FIG. 4, the bottom edge **34*b* of each vane is curved thus forming a convexly shaped edge engageable with the flat spring component 62 of the resilient element 60. When the vanes are fully extended, as shown in FIG. 4, the resilient element 60** lies flat across the entire vane slot region. At this point the resilient element is completely unflexed; and no portion thereof is under either compression or tension.

Figure 5:
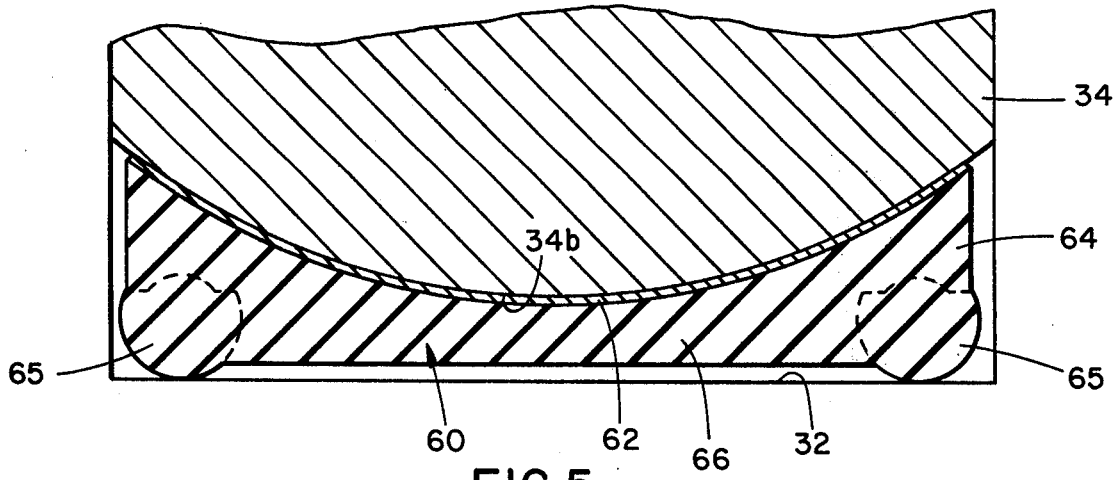
FIG. 5 is a view similar to FIG. 4 showing the resilient element in its fully flexed position.

As best shown in FIG. 5, the resilient element 60, after engagement with convexly shaped edge **34*b*, is in a condition where the resilient element assumes the same general contour as the bottom edge, and the elastomeric portion is forced downwardly so that the central region 66** is closely spaced from the bottom of the vane slot. At this point, the spring is in a condition to bias the vane upwardly against the inside cylinder wall or stator, and this will result in immediate pumping action upon start-up prior to the generation of enough centrifugal force to hold the vanes in contact with the cylinder wall.

Figure 6:
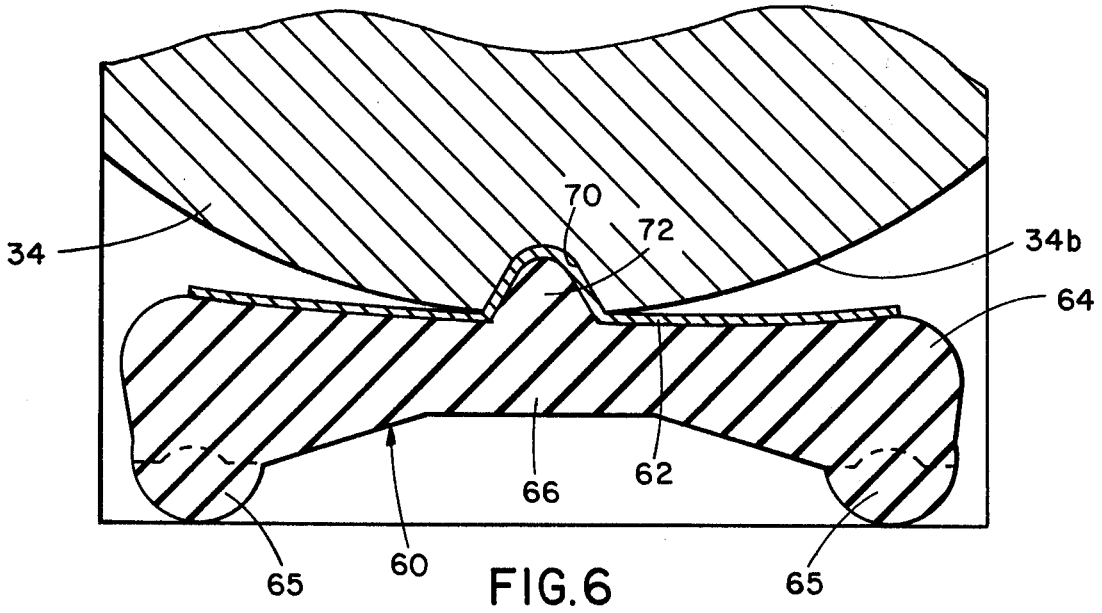
FIG. 6 is a view similar to FIG. 4, showing an alternate embodiment of the invention.

In FIG. 6 there is shown an alternate embodiment of the present invention. Since this embodiment contains many features in common with that described in connection with FIGS. 4 and 5, the same reference numerals are used to designate such common elements.

In the FIG. 6 embodiment, means are provided for accurately locating the vane with respect to the resilient element. This may take the form of a centrally located notched section 70 formed in the lower edge **34*b* of vane 34. A complementary shaped protuberance 72 extends into the notched section 70** to prevent lateral relative movement between the resilient element and the vane while still allowing the compressing and extending movements described in connection with the first embodiment.

While a variety of elastomeric compounds may be used in making element 66, they should be resistant to the oil-refrigerant environment in which they must operate in a refrigeration/air conditioning application. Suitable materials would include urethane, nitrile, epichlorohydrin and silicone rubbers.

While this invention has been described in connection with certain specific embodiments thereof, it is to be understood that this is by way of illustration and not by way of limitation; and the scope of the appended claims should be construed as broadly as the prior art will permit.

What is claimed is:

1. In a rotary compressor of the type including a cylindrical rotor having a plurality of extensible vanes received in complementary vane slots, the improvement comprising: means defining a convex edge on the radially inner portion of said vanes, and a resilient element engageable with said convex edge, said resilient element comprising a metal spring member and an elastomeric member bonded thereto having an intermediate section normally spaced from the bottom of said vane slots and adapted to flex downwardly upon engagement by said vane, said resilient element being sufficiently rigid to prevent collapse thereof in response to increased centrifugal forces.

2. Apparatus as defined in claim 1 including mutually engageable means on said vanes and said resilient elements to prevent lateral movement of said resilient elements in said vane slots.

3. Apparatus as defined in claim 1 wherein said elastomeric member is provided with spherically shaped terminal portions received in complementary sockets formed at the ends of each said vane slot.

* * * * *